United States Patent [19]

Knowles

[11] Patent Number: 5,040,684

[45] Date of Patent: Aug. 20, 1991

[54] FOLDABLE MULTI-PLY SHOCK-ABSORBING EDGE PROTECTOR

[76] Inventor: John R. Knowles, 346 Hickory Tr. Rd., Plymouth, Wis. 53073

[21] Appl. No.: 498,556

[22] Filed: Mar. 26, 1990

[51] Int. Cl.[5] ..... B65D 81/04

[52] U.S. Cl. ..... 206/586; 206/326; 229/DIG. 1; 248/345.1

[58] Field of Search ..... 206/586, 326, 320, 453; 229/DIG. 1; 248/345.1

[56] References Cited

U.S. PATENT DOCUMENTS

| | | | |
|---|---|---|---|
| 1,817,286 | 8/1931 | Beaman | 206/586 |
| 1,852,832 | 4/1932 | Beaman | 206/586 |
| 2,068,771 | 1/1937 | Sherman | 229/DIG. 1 |
| 2,750,032 | 6/1956 | Laird | 206/453 |
| 2,896,833 | 7/1959 | Markham | 206/586 X |
| 2,974,844 | 3/1961 | Lane | 206/453 X |
| 3,063,885 | 11/1962 | Kieffer | 206/586 X |
| 3,200,547 | 8/1965 | Johnson | 229/DIG. 1 |
| 3,335,932 | 8/1967 | Brown | 206/453 |
| 3,337,111 | 8/1967 | Petriekis et al. | 229/DIG. 1 |
| 3,669,252 | 6/1972 | Evans | 206/326 |
| 4,399,915 | 8/1983 | Sorenson | 206/586 |
| 4,700,844 | 10/1987 | Griffith | 206/586 |
| 4,784,270 | 11/1988 | Layer et al. | 206/586 |

*Primary Examiner*—Bryon P. Gehman

*Attorney, Agent, or Firm*—Francis J. Bouda

[57] ABSTRACT

The edge protector of the present invention is made of a plurality of sheets of inexpensive cardboard or linerboard cut into sections and laminated in a flat configuration. The laminations include at least one sheet which is continuous and provides a hinge portion, at least one sheet which is flexible and provides a stop—similar to a leaf spring. Protective laminates are disposed between the continuous member and the spring-like member and include a central portion and at least one leg portion. The leg portion can be pivoted about an axis in the continuous member, away from and at an angle to the central portion, thereafter to be held in angular disposition (that could vary in angular disposition restricted only to products' natural restrictions) with regard to the central portion by the spring-like portion. The edge protector of the present invention is particularly suited for protecting the edges of a large range of equipment such as furniture, desk-tops during the shipment or movement of such equipment or furniture. The channel of the present invention, when constructed, is flat, but when "set up", would be primarily an "L"-shape or "U"- shape configuration. But certainly not restricted to these configurations. They could be box-shaped, hexagonal, etc., limited only to a practical application of the spring hinge and hold concept.

4 Claims, 1 Drawing Sheet

FOLDABLE MULTI-PLY SHOCK-ABSORBING EDGE PROTECTOR

BACKGROUND OF THE INVENTION

For the protection of furniture during shipment or movement thereof, many devices have been suggested and provided as packaging supports or pads or corner protectors or the like, and I refer particularly to U.S. Pat. Nos.: 4,784,270; 4,399,915; 4,375,852; 4,360,145; 3,337,111; 974,844; 2,950,038; 2,914,232; 2,896,833; 2,783,930; 692,720; and 2,196,157.

Such devices, for economy purposes, have often been made of fiber board, liner board, or simlar flat cardboard, but may also be made of sheets of polystyrene or rubber or other similar flexible packaging material.

Most of these devices have been provided for the protection of corners such as Suess U.S. Pat. No. 2,692,720, but others have included edge-protectors such as shown in White U.S. Pat. No. 2,196,157 and Petriekis U.S. Pat. No. 3,337,111.

Although the devices of the prior art have been effective to protect the furniture, they have, in the past, required either an external carton or box to hold them in place against the furniture or some sort of belting or strapping to hold them in place. In some cases the channels may still require banding or boxing depending on the application, but the new channel would be self-gripping during the banding operation, making it much easier to use, and would reduce the banding required.

DESCRIPTION OF THE INVENTION

The edge protector of the present invention is an improvement on the prior art, in that although it includes a plurality of sheets of fiber board laminated together, scored and cut so as to be foldable, the arrangement of the various plys of fiberboard provide not only a hinge-portion, a plurality of shock-absorbing protective sheets, but also a spring-like portion which permits the flat, multi-ply sheet to be folded into an angular configuration and to be held therein by the snap-action of one of the sheets of fiber board.

Therefore, it is an object of the present invention to provide an inexpensive edge protector which can be easily manufactured, economically shipped in a flat condition, but quickly and easily and manually snapped into a channel-like configuration by the workmen of the shipping concern at the time the furniture is to be moved.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise ~~arrangements and organizations of the instrumentalities~~ as herein shown and described.

In the drawings, wherein like reference characters indicate like parts:

Figure 1:
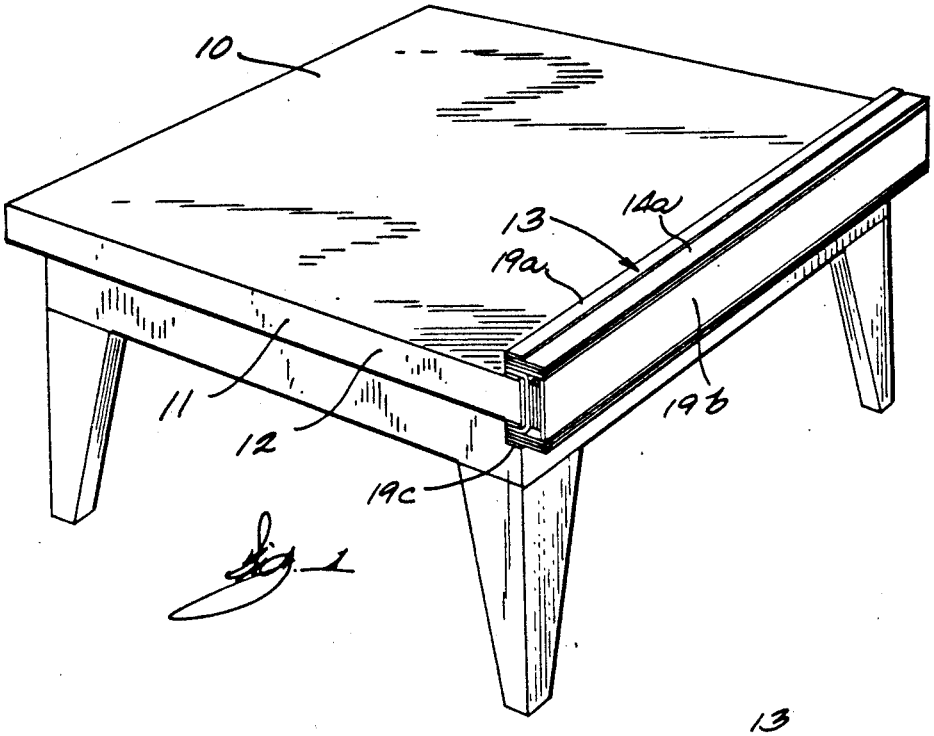
FIG. 1 is a perspective view of a piece of furniture such as a table, with the edge protector of the present invention disposed along one edge thereof to show how it can be applied in a protecting mode to a piece of furniture.

Referring now to FIG. 1 there is shown a piece of furniture 10, the top 11 of which has an edge 12 which should be protected during shipment or movement.

The edge protector 13 is disposed along one of the edges 12 and is held in clamping-like friction engagement with the edge thereof by virtue of the tension construction to be described hereafter.

Figure 2:
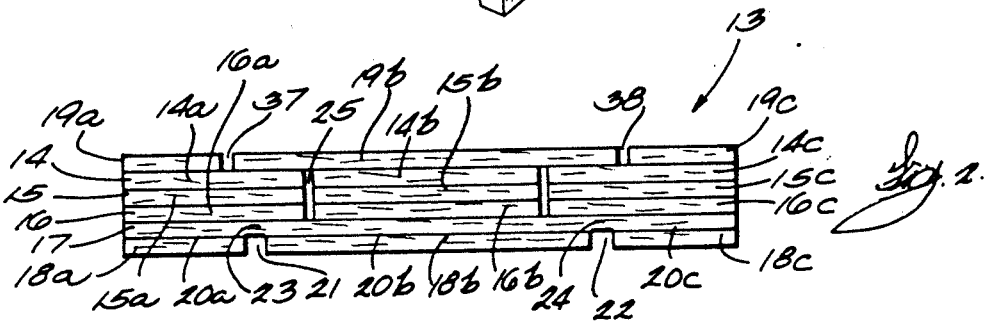
FIG. 2 is a greatly enlarged section of the multi-ply laminate edge protector of the present invention in its flat arrangement, prior to being folded into a channel-like protector.

Referring now to FIG. 2, one sees a 6-ply laminate of fiber board, liner board, cardboard, corrugated board, or the like. In this figure I have shown 3 plys, 14, 15 and 16, which provide the bulk of the shock-absorbing protective structure. It is to be understood that more or less sheets of laminate may be used, depending upon the type of protection to be provided and also upon the caliper, gauge or thickness of the various plys.

A continuous laminate 17 is provided between a plurality of furniture-contacting members 18*a*, *b* and *c*, and an outer ply consists of a plurality of laminates 19*a*, *b* and *c* secured to the other side of the protective sandwich, 14, 15, 16.

The furniture-contacting portions 18*a*, 18*b* and 18*c* are adhesively secured to the continuous member 17 along their adjacent interfaces as at 20*a*, 20*b* and 20*c*, but it will be noted that appropriate gap 21 separates the portions 18*a* and 18*b* in another appropriate gap 22 separates the portions 18*b* and 18*c*.

In the portion of ply 17 which spans the gap 21 and 22, a hinge-like section 23 is adjacent the gap 21 and a similar hinge-like section 24 is adjacent the gap 22.

The plys 14*a*, 15*a* and 16*a* are adhesively secured together to provide the sandwich, the portion 14*a* of which is adhesively secured along its mating face to the adjacent face of the outer ply 19*a*.

Likewise, the opposing face of the sections 16*a* is adhesively secured on its contacting portion to the opposed portion of the ply 17.

Similar construction is shown for the central portions 14*b*–15*b*–16*b* as well as the opposite leg portion 14*c*–15*c*–16*c*.

It will be noted that the gaps 25 and 26 which separate the sandwich 14*b*, 15*b* and 16*b* from the sandwiches 14*a*, 15*a*, 16*a*, as well as 14*c*, 15*c* and 16*c*, are displaced inwardly from the gaps 21 and 22, respectively.

Figure 3:
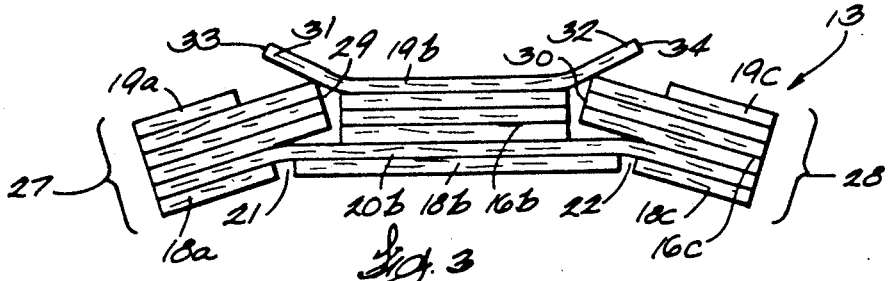
FIG. 3 is a view similar to FIG. 2 showing how the protective portions of the assembly can be pivoted about a foldline in one of the laminates, forcing another of the laminates into a spring-like tensioning position.

Thus when the leg portions generally indicated by 27 and 28 in FIG. 3 are pivoted about the foldlines 23 and 24, the inner edges 29 and 30 of the protective sandwiches 14*a*, 15*a*, and 16*a* and 14*c*, 15*c* and 16*c* are bent upwardly toward the flexible portions 31 and 32 of the panel 19*b*.

Because of the nature of the material of the fiber board which the edge protector is made, these portions 31 and 32, because of their flexibility, provide a mechanism similar to a leaf-spring which can be bent as shown in FIG. 3. When the bending continues until the edges 29 and 30 extend beyond the edges 33 and 34 of the spring portions 31 and 32, as shown in FIG. 4, the portions 31 and 32 snap back into an in-line relationship behind the edges 35 and 36 of the portions 31 and 32 to provide a "stop" or detent, which prevents the leg portions 27 and 28 from returning to the aligned position shown in FIG. 2.

Figure 4:
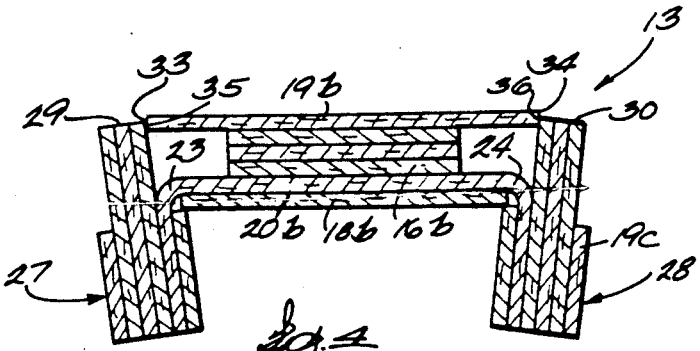
FIG. 4 is a cross-sectional view of the channel of the present invention after it has been completely folded with the spring-like portion snapping into place against the folded leg-portions to hold the protector in a channel-like configuration.

The length of the portions 31 and 32 may be appropriately chosen so that the gaps 37 and 38, between the central portion 19*b* and the respective adjacent members 19*a* and 19*c*, permit the legs 27 and 28 to be disposed at a slight inward angle as shown in FIG. 4 or may be at a 90 degree angle to the central portion 14*b*, 15*b*, 16*b*. (The angle could vary in range 45–135 degrees.)

In the preferred embodiment, there is a slight angular disposition so that when the channel is snapped into place around the edge 12 of a table shown in FIG. 1, the tension of the legs as they are spread slightly outwardly provides a self-gripping action of the furniture-contacting surfaces of the panels 18*a* and 18*c* to stay in place along the edge of the furniture without any strapping or further attachment. However, in some applications strapping may still be desired.

In a specific construction of my invention, the fiber board of the present invention is 1/32" thick, thus providing a multi-ply laminate 3/16" thick. The fiber board is generally described as liner board or fiber board, and because of its general construction, is capable of providing the limited leaf-spring-like action illustrated in FIG. 3 and yet providing the linear stiffness to afford the edge-stop arrangement shown in FIG. 4.

The continuous member 17 also has sufficient strength and body construction to provide the fold-lines 23 and 24 without breaking or separating and also sufficient tensile strength of the fibers therein to prevent separation along these fold lines 23 and 24 when the legs 27 and 28 are forced slightly outwardly from the position shown in FIG. 4 to provide the snap-holding retentive action illustrated in FIG. 1.

It is also clear from the description that the sheets in any one layer are of uniform thickness as, for instance, 18*a*, 18*b* and 18*c* are of uniform thickness. Nevertheless, it is not necessary that the sheets of adjacent layers be of the same thickness.

Likewise, the continuous member 17 may itself be a multi-ply sheet made of one or more plys of the fiber board or a ply of fiber board with a thin but plexible plastic member (not shown) which will provide a more effective hingelike portion in the areas 23 and 24.

Similarly, if the portion 19*b* is, itself, made of a multi-ply sheet, to affect more specific spring-like action, then the portions 19*a* and 19*c* should have the same thickness or caliper as the section 19*b*, so that when the panel is in its flat condition as shown in FIG. 2, there is a generally uniform thickness of the flat assembly across its entire area.

As I previously stated, the multi-plys 14, 15 and 16 need not be limited to the three layers shown in the drawings but may be thicker or thinner, as desired for the specific application. But, in any case, all the members providing this sandwich assembly should, in the aggregate, have the same caliper or thickness.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention, what I claim as new and desire to protect by Letters Patent are the following:

1. A protector (13) for protecting the edge of an article, said protector including:

a plurality of plys (14–19) of sheet-material, an outer ply consisting of a first piece (19*a*) and a second piece (19*b*) separated from each other by a first gap (37), an inner ply consisting of a first piece (18*a*) and a second piece (18*b*) separated from each other by a second gap (21), a continuous ply (17) adhered to both pieces (18*a* and 18*b*) of said inner ply and bridging said second gap (21), a body member (14–16) consisting of at least two parts, namely a first part (14*a*, 15*a* and 16*a*) and a second part (14*b*, 15*b* and 16*b*) separated by a third gap (25), said first part (14*a*, 15*a* and 16*a*) of said body member (14–16) adhered to said first piece (19*a*) of said outer ply and also to said continuous ply (17), said second part (14*b*, 15*b* and 16*b*) of said body member (14–16) adhered to said continuous ply (17) and to said second piece (19*b*) of said outer ply, a portion (31) of said second piece (19*b*) bridging said third gap (25) and overlying a portion of but not adhered to said first part (14*a*, 15*a* and 16*a*) of said body member (14–16), said continuous ply (17) being foldable along a line contiguous with said second gap (21).

2. The protector (13) of claim 1 wherein said first part (14*a*, 15*a* and 16*a*) and said second part (14*b*, 15*b* and 16*b*) of said body member (14–16) are separable along said third gap (25) when said continuous ply (17) is folded along said second gap (21).

3. The protector (13) of claim 2 wherein the said portion (31) of said second piece (19*b*) is flexible where it overlies the first part (14*a*, 15*a* and 16*a*) of said body member (14–16).

4. The protector (13) of claim 3 wherein an edge (33) of said portion (31) of said second piece (19*b*) of said outer ply is snappable into butting contact with the inner surface of said first part (14*a*, 15*a* and 16*a*) of said body member (14–16) when said continuous ply 17 is folded, whereby to prevent re-alignment of the plys of said protector.

* * * * *